US005357682A

United States Patent [19]

Henderson, Jr.

[11] Patent Number: 5,357,682

[45] Date of Patent: Oct. 25, 1994

[54] CORNERBEAD ALIGNMENT APPARATUS

[75] Inventor: Harvey Henderson, Jr., Pembroke Pines, Fla.

[73] Assignee: Best Manufacturing Co., Inc., Davie, Fla.

[21] Appl. No.: 149,373

[22] Filed: Nov. 9, 1993

[51] Int. Cl.[5] ..... G01C 15/10

[52] U.S. Cl. ..... 33/339; 33/1 LE; 33/407

[58] Field of Search ..... 33/1 LE, 282, 339, 353, 33/404, 407, 408, 409, 410, 413, 756, 757, 518

[56] References Cited

U.S. PATENT DOCUMENTS

| | | | |
|---|---|---|---|
| 1,783,883 | 12/1930 | Larrison | 33/339 |
| 1,824,321 | 9/1931 | Baker | 33/404 |
| 1,878,448 | 9/1932 | Cornuelle | 33/404 |
| 2,468,167 | 4/1949 | Bucalo | 33/404 |
| 2,559,697 | 7/1951 | Anders | 33/409 |
| 2,585,160 | 2/1952 | Munn | 33/409 |
| 2,769,240 | 11/1956 | Wells | 33/1 LE |
| 3,015,890 | 1/1962 | McCaskill | 33/339 |
| 3,273,245 | 9/1966 | Broosky | 33/410 |
| 3,276,128 | 10/1966 | Ponich | 33/407 |
| 3,276,129 | 10/1966 | Andrews | 33/407 |

*Primary Examiner*—Thomas B. Will
*Attorney, Agent, or Firm*—Harrison & Egbert

[57] ABSTRACT

An apparatus for the alignment of an edge of a cornerbead including a first clip for attachment to an upper edge of a section of cornerbead, a second clip for attachment to a lower portion of the edge of the cornerbead, and a line connected to the first and second clips and extending between the first and second clips. Both the first and second clips include a body, a first hook formed at one end of the body for engaging the metal lath of the cornerbead, and a second hook formed at an opposite end of the body for engaging the edge of the cornerbead. Both the first and second hooks extend outwardly from the same side of the body. The second hook is a semi-cylindrical member that has an interior area generally matching an exterior of the edge of the cornerbead. The first hook is angularly offset from the longitudinal axis of the semi-cylindrical member. An arm is formed so as to extend outwardly from the body.

8 Claims, 1 Drawing Sheet

CORNERBEAD ALIGNMENT APPARATUS

TECHNICAL FIELD

The present invention relates to apparatus used for the construction of buildings. More particularly, the present invention relates to apparatus used for the alignment of an edge of a cornerbead.

BACKGROUND ART

Wallboard or sheetrock is well known and is used to provide smooth wall surfaces to the interiors of buildings. As is also well known, the corner or edge where two wallboards form a ninety degree angle require a metal corner strip to protect the wallboard corners from breakage. This metal corner strip comprises a flat metal sheet which is bent at an angle along the longitudinal center thereof. Typically, the flat metal sheet has spaced openings therethrough for receiving fasteners or the like. The metal corner strip of this type is well known by the term "cornerbead" and shall be referred to by that term hereinafter.

Normally, the cornerbead is formed in a continuous section. Each section of cornerbead will include a corner edge and metal lath extending outwardly therefrom. The sections of cornerbead can be made at extremely long lengths. Conventionally, the cornerbead can be cut to the desired length and used during the construction of the building.

Unfortunately, in the past, the corner edge of the cornerbead can become deformed, distorted, or bent during shipping, transport, manufacture, and installation. In circumstances where the corner edge of the cornerbead does not form a straight linear edge, the edges of the building will take on the same deformation as the cornerbead. This can lead to a very undesirable appearance to the building. In many circumstances, home builders offer strong criticism for the effect of uneven or bent cornerbeads.

In the past, it has been fairly conventional for the builder to inspect the cornerbead visually. If the cornerbead does not appear to be bent, then it will generally be used during the construction of the building. If the cornerbead appears to be bent, then the builder will often bend the cornerbead into, what appears to be, a proper linear alignment. Other times, the builder will simply replace the cornerbead with a straighter section of cornerbead. Often, the builder's visual inspection of the cornerbead is inaccurate or ineffective.

In the past, various patents have issued relating to cornerbead used in the construction of buildings.

U.S. Pat. No. 3,754,367, issued on Aug. 28, 1973, to O'Konski et al. discloses a casing bead employed, as on metal lath, for plaster. The casing bead sections are adapted for joinder in abutting end-to-end relation. A splicing clip is utilized as part of the assembly and interacts with end-to-end abutting sections of the casing bead to hold the sections in rigid alignment.

U.S. Pat. No. 4,324,079, issued on Apr. 13, 1982, and U.S. Pat. No. 4,366,660, issued on Jan. 4, 1983, to R. J. Pearson disclose a cornerbead and corner clip. This cornerbead and corner clip includes an elongate formed and punched sheet metal cornerbead which is adapted to be easily cut into individual wallboard corner clips. This is designed specifically for use inside corners. The elongate slots include a repetitive pattern of longitudinally extending slots disposed between at least some of the laterally extending slots. The laterally extending slots are spaced outwardly from the bead section and inwardly from the outer edge of the flange section.

U.S. Pat. No. 4,587,173, issued on May 6, 1986, to Lat et al. describes a method for improving adhesion of joint compound to metal cornerbead. In this patent, the metal cornerbead for dry wall partitions is coated with a water-reducable acrylic resin to improve the adhesion of the joint compound to it. An aqueous solution of resin can be added to the roll-forming lubricant, such as hexylene glycol.

U.S. Pat. No. 5,157,887, issued on Oct. 27, 1992, to K. R. Watterworth, III, describes a fireproof structural assembly that comprises a bar joist having an outward flange along its base. Expanded metal lath is held in position against the bars and above the flange by attachment clips. The attachment clips each comprise a U-shaped base which pinches the flange, a stem to hold the lath in place, and a perpendicular end point which pokes through an opening in the lath to stabilize the clip. A thick layer of cementitious material adheres to the lath in the area of the bars and flanges.

U.S. Pat. No. 5,209,097, issued on May 11, 1993, to G. Lallier teaches a fluid operated cornerbead crimping tool. This tool is used for crimping cornerbead to wallboard. This device utilizes a handle portion, an intermediate air cylinder portion, and a crimping head portion which together forms the crimping tool.

It is an object of the present invention to provide a cornerbead alignment apparatus that enhances the visual ability to determine deformations along the corner edge of the cornerbead.

It is another object of the present invention to provide a cornerbead alignment apparatus that facilitates the repair and maintenance of the cornerbead.

It is another object of the present invention to provide a cornerbead alignment apparatus that improves the efficiency of cornerbead inspection.

It is still a further object of the present invention to provide a cornerbead alignment apparatus that is easy to use, relatively inexpensive, and easy to manufacture.

These and other objects and advantages of the present invention will become apparent from a reading of the attached specification and appended claims.

SUMMARY OF THE INVENTION

The present invention is an apparatus for the alignment of an edge of cornerbead that includes a first clip for attachment to an upper portion of an edge of a section of cornerbead, a second clip for attachment to a lower portion of the edge of the section of cornerbead, and a line extending between the first and second clips.

The first and second clips include a body portion, a first hook formed at one end of the body for engaging the metal lath of the section of cornerbead, and a second hook formed at an opposite end of the body for engaging the edge of the section of cornerbead. The first hook extends outwardly from a side of the body. The second hook extends outwardly from the same side of the body. The second hook is a semi-cylindrical member having an interior area generally matching an exterior of the edge of the section of cornerbead. The first hook is angularly offset from the longitudinal axis of the second hook. Both the first and second clips have an identical configuration.

The semi-cylindrical portion of the second hook is connected to an end of the line. The line extends vertically between the first and second clips. The body includes an arm which extends outwardly therefrom.

DETAILED DESCRIPTION OF THE INVENTION

Figure 1:
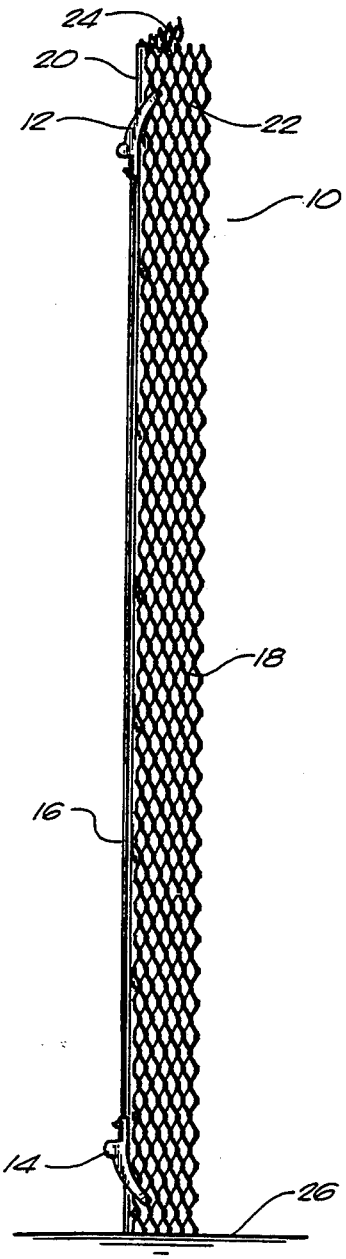
FIG. 1 is a perspective view showing the installation of the cornerbead alignment apparatus of the present invention on a section of cornerbead.

Referring to FIG. 1, there is shown at 10 the cornerbead alignment apparatus in accordance with the present invention. The apparatus 10 includes a first clip 12, a second clip 14, and a line 16 extending between the first clip 12 and the second clip 14. As can be seen, the clips 12 and 14 engage cornerbead 18. The cornerbead 18 includes a corner edge 20 having a first section of metal lath 22 extending outwardly therefrom and a second section of metal lath 24 extending outwardly therefrom. The cornerbead 18 is shown as having a generally standard configuration. In this standard configuration, the sections 22 and 24 will extend at Generally eighty degree angles with respect to each other. The cornerbead 18 is extending upwardly from the floor 26.

In general, during the installation of the cornerbead 18, it is important to ascertain that the corner edge 20 has a continuously straight and vertical configuration. Often, if small bends or distortions occur during manufacturing and/or installation, it is often very difficult to properly ascertain whether a straight line is shown by the corner edge 20. As a result, the cornerbead alignment apparatus 10 of the present invention was developed.

In FIG. 1, the first clip 12 has a first hook formed at one end which engages the metal lath section 22. A second hook is formed at an opposite end of the body and extends over the corner edge 20. Similarly, the second clip 14 includes a first hook that engages the metal lath 22 of the cornerbead 18 and a second hook that engages the corner edge 20. It can be seen that the first clip 12 is positioned adjacent to an upper end of the cornerbead 18. The second hook 14 is positioned generally adjacent to the floor 26 at the bottom end of the cornerbead 18. The line 16 will extend vertically between the first clip 12 and the second clip 14.

The manner in which the first clip 12 engages the cornerbead 18 and the manner in which the second clip 14 engages the cornerbead 18 assures that the line 16 will extend generally vertically therebetween over the length of the cornerbead 18. As a result, distortions or bends along the corner edge of the cornerbead 18 will become readily apparent. When a bend occurs, the corner edge 20 will separate from the vertical line 16. As such, visual inspection of the linearity of the corner edge 20 can be readily carried out. Whenever these distortions are discovered, the cornerbead 18, and its corner edge 20, can be appropriately bent or repaired so as to establish the proper linearity. When the corner edge 20 is properly linear, it will align in parallel relationship to the line 16. The clips 12 and 14, and the line 16, can be removed from the cornerbead 18 and utilized on another section of cornerbead 18.

Figure 2:
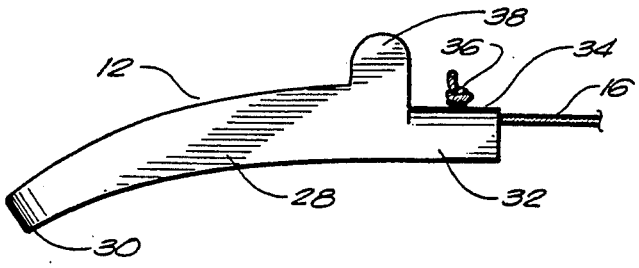
FIG. 2 is a side elevational view of a clip of the present invention.

FIG. 2 illustrates the first clip 12. It is important to note that the second clip 14 has an identical configuration as the first clip 12. The first clip 12 includes a body 28, a first hook 30, and a second hook 32. The first hook 30 is formed at one end of the body 28. A first hook 30 is utilized (with reference to FIG. 1) for engaging the metal lath 22 of the cornerbead 18. The second hook 32 is formed at an opposite end of the body 28. The second hook 32 (with reference to FIG. 1) will engage the corner edge 20 of the cornerbead 18. The line 16 is affixed to the back 34 of the second hook 32. Specifically, the line 16 is a string that is tied in a knot 36 on the exterior of the back 34 of the second hook 32. An arm 38 extends outwardly of the body 28 so as to extend outwardly of the corner edge 209 of the cornerbead 18. The arm 38 facilitates the ability to attach and remove the clip 12 from its position on the cornerbead 18.

Figure 3:
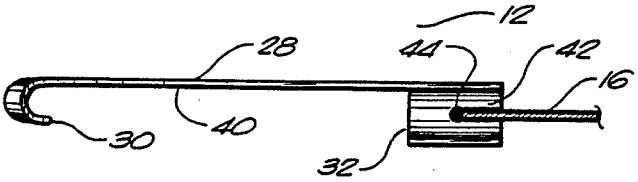
FIG. 3 is a bottom view of the clip of the present invention.

FIG. 3 shows that the body 28 is a generally flat planar member. The first hook 30 extends outwardly from the side 40 of the body 28. The second hook 32 also extends outwardly from the side 40 of the body 28. The first hook 30 has a generally U-shaped configuration extending inwardly back toward the second hook 32. The second hook 32 has a generally semi-cylindrical or semi-tubular configuration. The interior surface 42 of the second hook 32 generally conforms to and matches the exterior surface of the corner edge 20 of the cornerbead 18. It can be seen that the line 16 extends into the second hook 32 and into a hole 44 formed on the back of the second hook 32.

Figure 4:
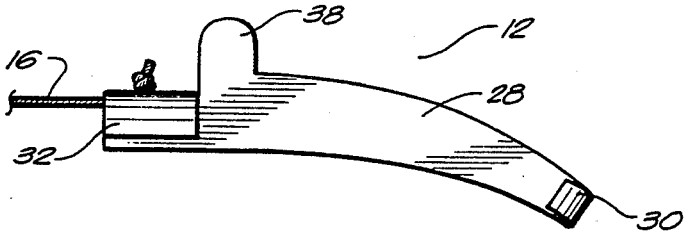
FIG. 4 is a rear elevational view of the clip of the present invention.

FIG. 4 shows a rear view of the clip 12. The body 28 has the first hook 30 formed at one end and the second hook 32 formed at the other end. Arm 38 extends upwardly from the body 28. In FIG. 4, it can be seen that the second hook 32 has a semi-cylindrical configuration. This semi-cylindrical configuration has a longitudinal axis extending therethrough. It can be seen that the first hook 30 is angularly offset from the longitudinal axis of the second hook 32. This configuration allows the clip 12 to be properly aligned on the cornerbead 18 for the purpose of determining the linearity of the corner edge 20. As such, the line 16 will provide a proper linear and vertical guide for the alignment of the corner edge 20 of the cornerbead 18. After the necessary repairs, adjustments, or inspections are made, then the clips 12 and 14, and the line 16, can be removed and placed on another cornerbead. The identical configuration of the clips 12 and 14 avoids confusion as to the proper installation procedures.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. An apparatus for alignment of an edge of cornerbead comprising:

a first clip means for attachment to an upper portion of an edge of a section of cornerbead, said first clip means comprising:

a body;

a first hook means formed at one end of said body, said first hook means for engaging metal lath of the section of cornerbead, said first hook means comprising a hook member extending outwards from a side of said body; and a second hook means formed at an opposite end of said body, said second hook means for engaging the edge of the section of cornerbead, said second hook means comprising a semi-cylindrical member extending outwardly from said side of said body, said semi-cylindrical member having an interior area generally matching an exterior of the edge of the section of cornerbead, said semi-cylindrical member having a hole formed therein, said hole extending through said semi-cylindrical member transverse to a longitudinal axis of said semi-cylindrical member;

a second clip means for attachment to a lower portion of the edge of the section of cornerbead, said second clip means having an identical configuration as said first clip means; and a line connected to and extending between said first and second clip means, said line having its end received within respective said holes of said second hook means of said first and second clip means.

2. The apparatus of claim 1, said semi-cylindrical member having said longitudinal axis, said first hook means being angularly offset from said longitudinal axis.

3. The apparatus of claim 1, said body having an arm extending outwardly therefrom.

4. The apparatus of claim 1, said line extending vertically between said first and second clip means.

5. A clip for a section of cornerbead comprising:

a body;

a first hook means formed at one end of said body, said first hook means for engaging metal lath of the section of cornerbead; and a second hook means formed at an opposite end of said body, said second hook means for engaging the edge of the section of cornerbead, said second hook means comprising a semi-cylindrical member, said semi-cylindrical member extending outwardly from said side of said body, said semi-cylindrical member having an interior area generally matching an exterior of the edge of the section of cornerbead, said semi-cylindrical member having a longitudinal axis, said semi-cylindrical member having a hole opening to said interior area and extending transverse to said longitudinal axis.

6. The clip of claim 5, said first hook means comprising a hook member extending outwardly from a side of said body.

7. The clip of claim 5, further comprising:

a line connected to said semi-cylindrical member at a back of said semi-cylindrical member, said line extending through said hole.

8. An alignment device comprising:

a section of cornerbead having a corner edge and metal lath extending outwardly from said corner edge;

a first clip means affixed adjacent to an upper end of said corner edge of said section, said first clip means comprising:

a body;

a first hook member formed at one end of said body, said first hook member for engaging metal lath of the section of cornerbead; and a second hook member formed at an opposite end of said body, said second hook member engaging said corner edge;

a second clip means affixed adjacent to a lower end of said corner edge of said section; and a line connected at one end to said first clip means and at an opposite end to said second clip means, said line extending in generally parallel relationship to said corner edge, said second clip means having an identical configuration as said first clip means, said line connected through a hole in a back of said second hook member, said line extending along and juxtaposed against said corner edge.

* * * * *